US010261471B2

(12) United States Patent
Bertrand et al.

(10) Patent No.: US 10,261,471 B2
(45) Date of Patent: Apr. 16, 2019

(54) TIMEPIECE TRANSMISSION DEVICE

(71) Applicant: ROLEX SA, Geneva (CH)

(72) Inventors: Jean-Louis Bertrand, Feigeres (FR); Pascal Billet, Morbier (FR); Pierre-Alain Graemiger, Trelex (CH); Félix Grasser, Grand-lancy (CH)

(73) Assignee: ROLEX SA, Geneva (CH)

( * ) Notice: Subject to any disclaimer, the term of this patent is extended or adjusted under 35 U.S.C. 154(b) by 0 days.

(21) Appl. No.: 15/319,933

(22) PCT Filed: Jun. 17, 2015

(86) PCT No.: PCT/EP2015/063649
§ 371 (c)(1),
(2) Date: Dec. 19, 2016

(87) PCT Pub. No.: WO2015/193400
PCT Pub. Date: Dec. 23, 2015

(65) Prior Publication Data

US 2017/0123376 A1 May 4, 2017

(30) Foreign Application Priority Data

Jun. 19, 2014 (EP) ..... 14173119

(51) Int. Cl.
*G04B 5/18* (2006.01)
*G04B 5/20* (2006.01)
*G04B 11/00* (2006.01)

(52) U.S. Cl.
CPC ..... *G04B 5/18* (2013.01); *G04B 5/20* (2013.01); *G04B 11/00* (2013.01)

(58) Field of Classification Search
CPC . G04B 5/18; G04B 5/20; G04B 11/00; G04B 5/19; G04B 5/02; G04B 5/14;
(Continued)

(56) References Cited

U.S. PATENT DOCUMENTS 2,867,971 A * 1/1959 Bertsch ..... G04B 5/02 368/148
3,628,326 A * 12/1971 Polo ..... G04B 5/02 368/208
9,400,488 B2 * 7/2016 Marechal ..... G04B 5/12

FOREIGN PATENT DOCUMENTS

CH 330891 A 6/1958
CH 460 639 A 9/1968
(Continued)

OTHER PUBLICATIONS

B. Humbert, "La montre suisse à remontage automatique" [Automatic winding Swiss watch], Journal Suisse d'Horlogerie et de Bijouterie, 2001, p. 5, figure 7 (1 page).
(Continued)

*Primary Examiner* — Edwin A. Leon
(74) *Attorney, Agent, or Firm* — Westerman, Hattori, Daniels & Adrian, LLP

(57) ABSTRACT

A timepiece transmission device (100), particularly for a timepiece mechanism (110) and specifically for an automaton chain (5) of a timepiece movement (120), includes: a first device (1), particularly a first freewheel device (1), for unidirectionally connecting a first portion (1*a*) to a second portion (1*b*); and a brake (2) arranged so as to brake, particularly by friction, the first portion in relation to the second portion.

23 Claims, 5 Drawing Sheets

(58) Field of Classification Search
CPC ..... G04B 5/12; G04B 11/028; G04B 11/003; G04B 5/24; G04B 11/008; F16D 41/12; H04M 1/0216
USPC ..... 368/206–208, 147–148; 968/44, 50, 54
See application file for complete search history.

(56) References Cited

FOREIGN PATENT DOCUMENTS

| | | | | |
|---|---|---|---|---|
| CH | 595 653 | B | 2/1978 | |
| CH | 694 025 | A5 | 6/2004 | |
| EP | 1134626 | A1 * | 9/2001 | ..... G04B 5/19 |
| WO | 2013/014515 | A1 | 1/2013 | |

OTHER PUBLICATIONS

International Search Report and Written Opinion dated Dec. 2, 2015 issued in corresponding application No. PCT/EP2015/063649; w/ English partial translation and partial machine translation (20 pages).

* cited by examiner

TIMEPIECE TRANSMISSION DEVICE

The invention relates to a timepiece transmission, which means to say motion or power transmission, device. It also relates to a timepiece mechanism comprising such a device. It further relates to a timepiece movement comprising such a device or such a mechanism. It finally relates to a timepiece, notably a wristwatch, comprising such a device, such a mechanism or such a movement. The invention relates in particular to an automatic winding device with a one-way winding or to an automatic winding chain.

In known automatic winding devices with one-way winding, in a first direction of rotation of an oscillating mass, a kinematic chain allows the oscillating mass to be connected to the barrel in such a way as to allow the winding of a mainspring. In a second direction of rotation of the oscillating mass, the kinematic chain between the mass and the barrel is unclutched by a clutch device such that rotation of the mass has no effect on the barrel. One known problem with this type of automatic winding device lies in the fact that the oscillating mass may experience significant accelerations in the second direction of rotation, and this leads to unwanted noise and to the risk of premature wearing of the elements of the automatic winding device, notably if the wristwatch suffers knocks.

Document CH595653 discloses a one-way winding device in which an intermediate transmission element pivoting on a clutch lever is able to oscillate between two positions according to the direction of rotation of the oscillating mass. According to FIG. 1 of that document, in a first direction of rotation of the oscillating mass, the intermediate transmission element is arranged in such a way that it is able to establish a kinematic chain between the oscillating mass and the barrel so as to allow the mainspring to be wound. In a second direction of rotation of the oscillating mass, the connection between the intermediate transmission element and the barrel is unclutched under the effect of the disengagement of the clutch lever. The embodiment of this document therefore exhibits the disadvantage mentioned hereinabove.

The work "La montre suisse á remontage automatique [Swiss self-winding watches]" (B. Humbert) [page 5, FIG. 7] discloses a one-way connection established by a pawl designed to collaborate with an elastic means which is carried directly on the oscillating mass. In a first direction of rotation of the oscillating mass, the pawl is configured and arranged in such a way that it makes it possible to establish a kinematic chain between the oscillating mass and the barrel, possibly via a wheel having asymmetric teeth. In a second direction of rotation of the mass, the pawl is disengaged from the gear train of the automatic winding chain and the oscillating mass can thus turn freely.

A one-way connection between the oscillating mass and the barrel can also be established by a freewheel such as a radial clutch using balls or rollers like the one disclosed in document CH330891 or alternatively those disclosed in document CH694025. Such clutches comprise inner and outer rings which can be locked together in rotation by the wedging of at least one ball or roller within a cage arranged at the interface of the two rings under the effect or lack of effect of a return torque. To achieve that, the cage is made up of at least one part that has an inclined plane configured to wedge a ball or a roller. Such a clutch or such a freewheel is depicted by way of example in FIGS. 9*a* and 9*b* of the present document.

Freewheels are commonly coupled and used to implement automatic winding devices with two-way winding like the one disclosed for example in patent CH694025, which means that it is difficult to achieve a compact automatic winding architecture.

The object of the invention is to provide a transmission device that makes it possible to overcome the abovementioned disadvantages and to improve the transmission devices known from the prior art. In particular, the invention proposes a transmission device that is simple and robust for an automatic winding chain and which makes it possible to avoid the oscillating mass being able to be subjected to excessive speeds and excessive accelerations, notably when the oscillating mass is not acting on the barrel.

A timepiece device according to the invention is defined by point 1:

1. A timepiece transmission device, notably for a timepiece mechanism, particularly for an automatic winding chain of a timepiece movement, comprising:
   - a first one-way connection device, notably a first freewheel device providing connection between a first part and a second part, and
   - a brake designed to brake, notably to brake by friction, the first part relative to the second part.

Various embodiments of the device are defined by points 2 to 8:

2. The transmission device as defined in the preceding point, wherein the first part comprises a first freewheel device ring, notably a freewheel device inner ring, and the second part comprises a second freewheel device ring, notably a freewheel device outer ring.
3. The transmission device as defined in the preceding point, wherein the brake is in contact with the first and second parts, particularly with the first and second rings.
4. The transmission device as defined in point 2 or 3, wherein the brake is attached or fixed to the first ring.
5. The transmission device as defined in one of the preceding points, wherein the brake is arranged in such a way as to act on a surface of the second part, notably on a planar surface of the second part, or on a surface of the second ring, notably on a planar surface of the second ring.
6. The transmission device as defined in one of the preceding points, wherein the brake comprises a spring, notably a spring washer.
7. The transmission device as defined in one of the preceding points, wherein the brake is preloaded by the first part and/or the second part.
8. The transmission device as defined in one of the preceding points, wherein the first one-way connecting device includes at least one blocking element, notably at least one blocking element of the ball or roller type.

A mechanism according to the invention is defined by point 9:

9. An automatic winding mechanism for a timepiece movement, comprising an oscillating mass, a barrel and an automatic winding chain, the automatic winding chain comprising a transmission device as defined in one of the preceding points.

Various embodiments of the mechanism are defined by points 10 to 14:

10. The winding mechanism as defined in the preceding point, wherein the oscillating mass is attached or fixed to the first part, notably to the first ring, or to the second part, notably to the second ring.
11. The winding mechanism as defined in points 9 or 10, wherein a pinion kinematically connected to the barrel, particularly to the barrel ratchet, is attached or fixed to the first part, notably to the first ring, or to the second part, notably to the second ring.

12. The winding mechanism as defined in one of points 9 to 11, wherein the barrel, particularly the barrel ratchet, is kinematically linked to the first part, notably to the first ring, or to the second part, notably to the second ring.
13. The winding mechanism as defined in one of points 9 to 12, and which comprises a framework and a second one-way connection device, the second one-way connection device being interposed between the barrel, particularly the barrel ratchet, and the framework, the second one-way connection device comprising a third ring and a fourth ring.
14. The winding mechanism as defined in the preceding point, wherein one single same ring constitutes the first and fourth rings.

A movement according to the invention is defined by point 15:

15. A timepiece movement comprising a device as defined in one of points 1 to 8 and/or a mechanism as defined in one of points 9 to 14.

A watch according to the invention is defined by point 16:

16. A timepiece, particularly a self-winding wristwatch, comprising a device as defined in one of points 1 to 8 and/or a mechanism as defined in one of points 9 to 14 and/or a timepiece movement as defined in the preceding point.

The attached figures depict by way of example a number of embodiments of a timepiece incorporating a transmission device according to the invention.

Figure 9A:
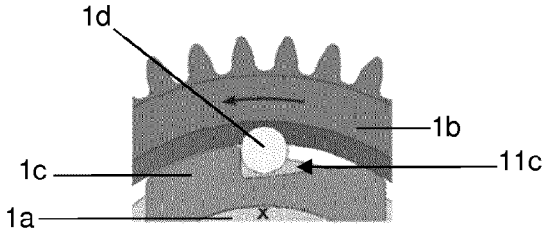
Figure 9B:
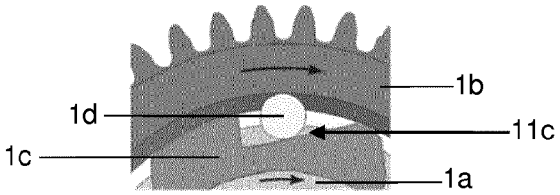

FIGS. 9*a* and 9*b* depict one example of a one-way connection device that can be used in a device according to the invention.

A first embodiment of a timepiece according to the invention is described hereinbelow with reference to FIGS. 1 to 3. The timepiece 130 is, for example, a watch, notably a wristwatch. The timepiece comprises a timepiece movement 120, for example a mechanical movement. The timepiece movement comprises a self-winding mechanism 110. The mechanism comprises a winding chain or automatic winding chain 5 extending from an oscillating mass 30 to a barrel 41, these elements being excluded from the winding chain or from the automatic winding chain. The winding chain includes a transmission device 100.

The transmission device comprises:

- a first one-way connection device 1 connecting a first part 1*a* of the transmission device and a second part 2*a* of the transmission device, and
- a brake 2 designed to act, notably to act by friction, relatively between the first part of the transmission device and the second part of the transmission device.

The brake may be placed between the first part of the transmission device and the second part of the transmission device. Alternatively, the brake or a first brake part may be included in the first part of the transmission device or in the second part of the transmission device.

The first one-way connection device may comprise a freewheel device or a one-way clutch device, notably a one-way radial clutch. The freewheel device may comprise at least one blocking element 1*d*, notably at least one blocking element of ball or roller type.

The first part may comprise a first freewheel device ring 1*a*, notably a freewheel device inner ring, and the second part may comprise a second freewheel device ring 1*b*, notably a freewheel device outer ring.

The brake may notably comprise an elastic element or spring comprising a first friction zone 29 able to collaborate with a second friction zone 28 to provide friction braking. The elasticity or stiffness of the spring makes it possible to define the load with which the first and second friction zones are pressed against one another. This pressing force combined with the coefficient of friction between the first and second zones makes it possible to define a braking torque. The first and second zones may be two planar or substantially planar surfaces, notably a planar surface 29 of the spring and a planar surface 28 of the second ring.

The spring may comprise an elastic washer, notably a spring washer, for example of Belleville type. Thus, the spring may be preloaded by the first part and/or by the second part.

The braking torque may thus be defined so that it adequately opposes the mechanical torque produced by the oscillating mass about its axis in the direction that does not wind the movement. The direction that does not wind the movement here means a direction of rotation of the oscillating mass for which the kinematic chain between the mass and the barrel is unclutched such that rotation of the mass has no effect on the barrel. The oscillating mass may exert, about its axis of rotation, in the absence of acceleration, a maximum torque, namely may exert, about its axis of rotation, a maximum static torque. For example, the braking torque is less than the maximum static torque produced by the oscillating mass so as not to halt the rotation of the mass, and thus promote the performance of the automatic winding device, particularly its ability to wind. The braking torque may be less than 75% of the maximum static torque, or even less than 70% of the maximum static torque. The braking torque may be greater than 20% of the maximum static torque, or even greater than 25% of the maximum static torque. The braking torque provides resistance to the movement of the oscillating mass 3 in the direction of non-winding of the barrel 41, namely when the rings 1*a* and 1*b* are uncoupled. Optionally, the braking torque may vary, notably according to the accelerations of the oscillating mass. These accelerations differ according to use or wearer. In order to achieve that, an adjusting mechanism may act on the preload of the spring.

Such a design makes it possible to achieve a one-way winding device that is particularly compact and high performance and which does not have the known defects of the prior art.

Figure 1:
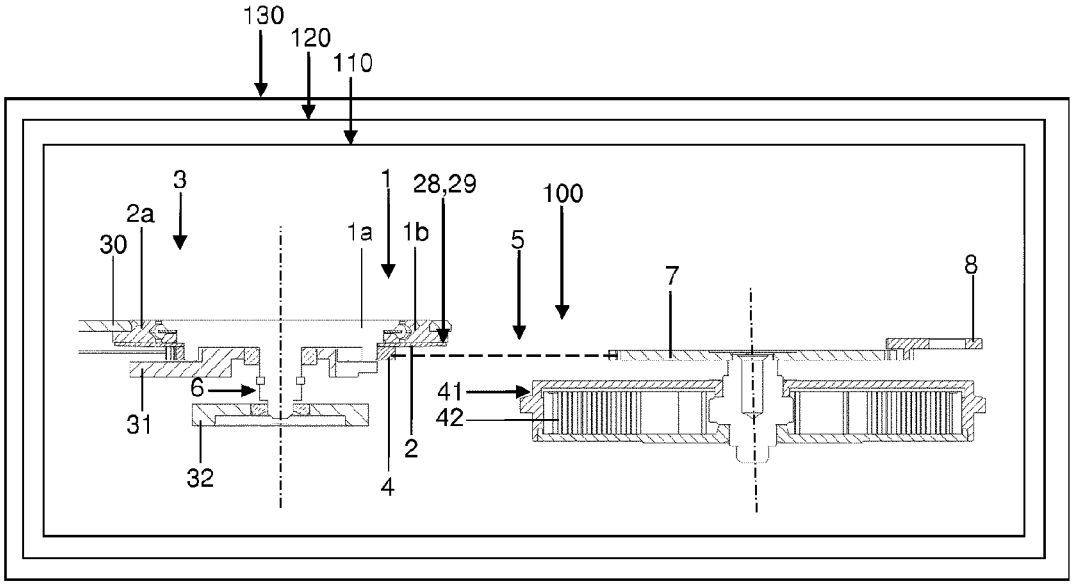
FIGS. 1 to 3 depict a first embodiment of a timepiece according to the invention.
Figure 2:
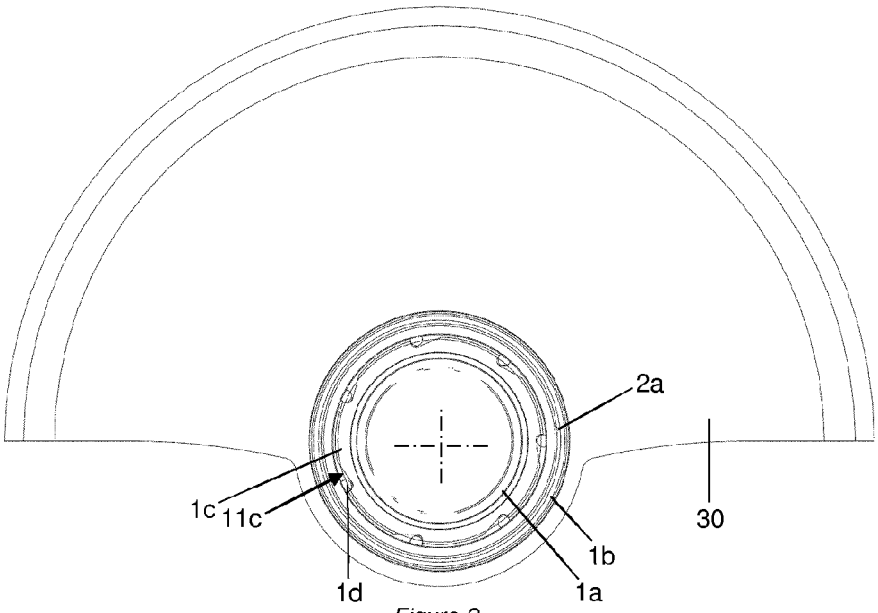
Figure 3:
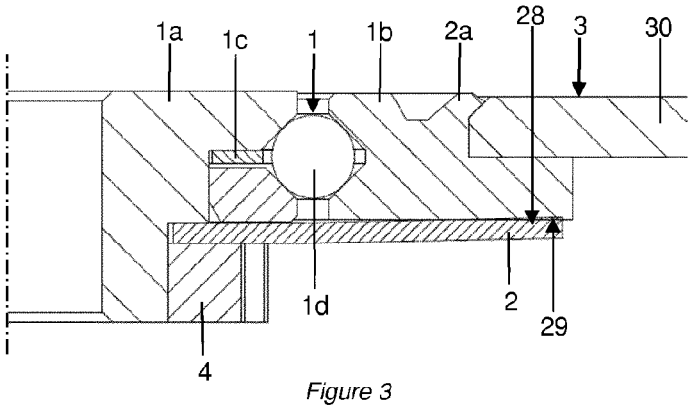

In the embodiment of FIGS. 1 to 3, the one-way connection device comprises a radial clutch with balls 1. Such a clutch technology, just like the technology involving rollers, has the advantage of minimizing the dead angle when switching from a direction of non-winding to a direction of winding, namely the angle covered by the oscillating mass in the direction of winding without winding the barrel just after having moved in the opposite direction to the direction of winding.

As seen earlier, the clutch 1 comprises an inner ring 1*a* and an outer ring 1*b*. A cage 1*c*, for example secured to the inner ring 1*a*, is provided with various pockets 11*c* in which the blocking elements 1*d* become lodged. The operation of such a clutch is illustrated in FIGS. 9*a* and 9*b*, the clutch being depicted in the disengaged position in FIG. 9*a* and the clutch being depicted in the engaged position in FIG. 9*b*.

With a device according to the invention, the inner ring 1*a* and outer ring 1*b* here have the specific feature of being capable of being uncoupled frictionally through the interposition of the brake 2.

Thus, the brake is in contact with the first and second parts, particularly with the first and second rings. The brake is, for example, attached or fixed to the first ring. For example, the spring 2 is secured to the inner ring 1*a* by means of a first pinion 4 of the automatic winding chain 5 (or automatic winding gear train) which is attached, notably driven home, onto the ring 1*a*, for example onto a portion of the exterior periphery of the ring 1*a*. A mass segment 30 of the oscillating mass 3 is fixed, notably attached, for example riveted, to a portion of the outer ring 1*b*.

As depicted in FIGS. 2 and 3, the spring is secured to a first end of the inner ring 1*a* which is in mesh with the automatic winding chain 5, while a second end of the spring bears against the contact surface 28 of the outer ring 1*b* which is secured to the oscillating mass 3. The geometry, notably the diameter and cross section, of the spring, and the preload applied to the latter define a resistive torque that is desired.

In the first embodiment of the device, the inner ring 1*a* bears a shaft 6 so as to allow the mass 3 to pivot relative to the framework of the movement within, for example, dedicated movement blanks 31, 32.

In the first direction of rotation of the oscillating mass 3, the automatic winding chain 5 is rotationally driven under the effect of the pinion 4 and thus allows the mainspring 42 of the barrel 41 to be wound via a ratchet 7. In this configuration, the inner ring 1*a* is rotationally driven under the effect of the outer ring 1*b* by the interposition of the balls 1*c* which are wedged by the cage 1*c*, notably by the pockets 11*c*. Thus, the spring 2, attached or fixed to the inner ring 1*a*, is rotationally driven under the effect of the outer ring 1*b*. This one therefore has no braking effect on the ring 1*b*. In the second direction of rotation of the oscillating mass, namely the direction of not winding the movement, the kinematic chain between the oscillating mass and the barrel is interrupted by the clutch device 1 such that the rotation of the mass then has no effect on the barrel. In this configuration, a pawl 8, notably an elastic pawl 8 of the ratchet 7, keeps the automatic winding chain 5 in position, give or take the lash of the gears. Thus, the outer ring 1*b* moves relative to the inner ring 1*a*, which is held in position by the pawl 8, through the interposition of the balls 1*c* which are free inside the pockets 11*c* of the cage 1*c*. More particularly, the outer ring 1*b* is frictionally uncoupled from the inner ring 1*a* through the interposition of the brake 2. The mass 3 and the outer ring 1*b* can therefore turn relative to the inner ring 1*a* and against the resistive torque produced by the friction of the spring 2 against the outer ring 1*b*.

Figure 4:
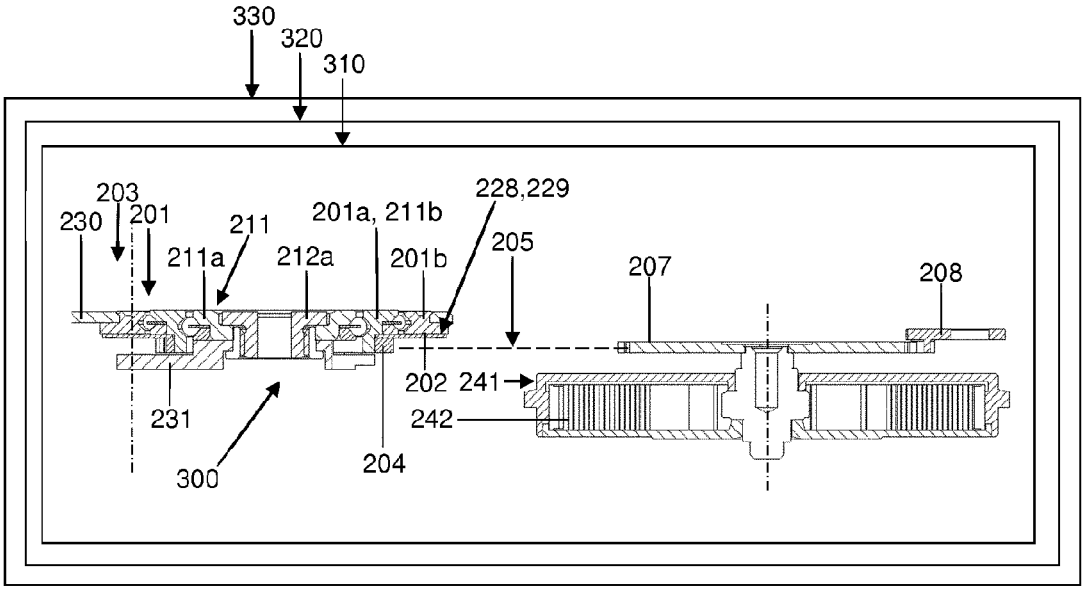
FIGS. 4 and 5 depict a second embodiment of a timepiece according to the invention.
Figure 5:
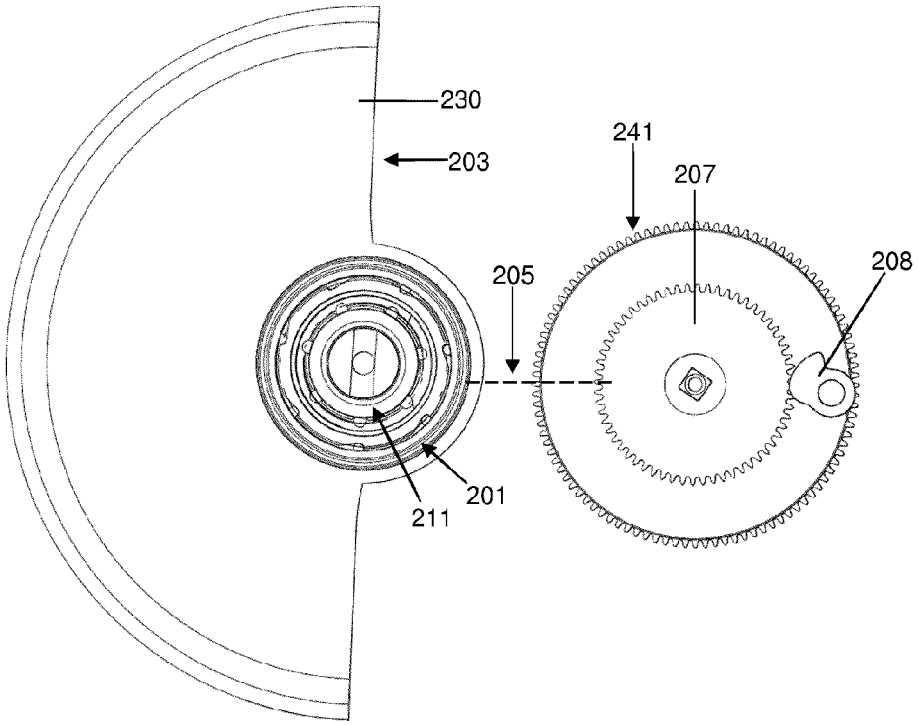

A second embodiment of the winding mechanism 310 is described hereinbelow with reference to FIGS. 4 and 5. In this embodiment, the numerical references of the elements are defined by the numerical references of the elements of the first embodiment that perform the same functions, to which numerical references 200 has been added.

The second embodiment is characterized in that the clutch device 201 and the oscillating mass 203 are borne via a ball bearing 211 on the movement framework. For that, the inner ring 201*a* for example acts as the outer ring 211*b* of the bearing 211. The inner ring 211*a* of the bearing 211 here is secured to the movement framework by a retaining screw 212*a*. The principle of operation of this embodiment is identical to that of the previous embodiment, the elastic pawl 208 being designed to hold the automatic winding chain 205 in position, give or take the lash of the gears, as the mass rotates in a direction that does not wind the movement. Thus, the mass 203 and the outer ring 201*b* can rotate relative to the inner ring 201*a*, 211*b*, against a resistive torque produced by the spring 202.

Figure 6:
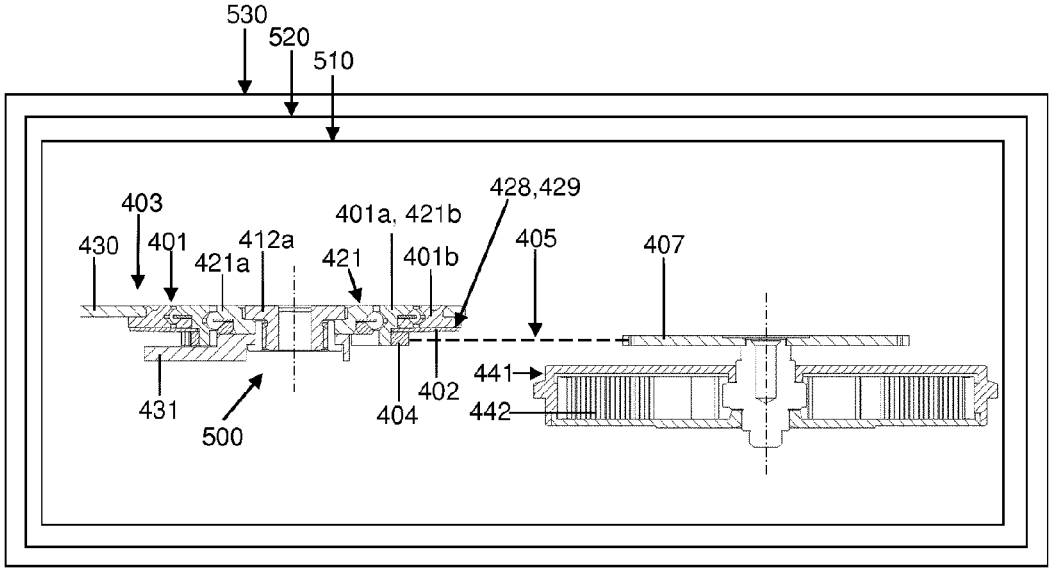
FIGS. 6 to 8 depict a third embodiment of a timepiece according to the invention.
Figure 7:
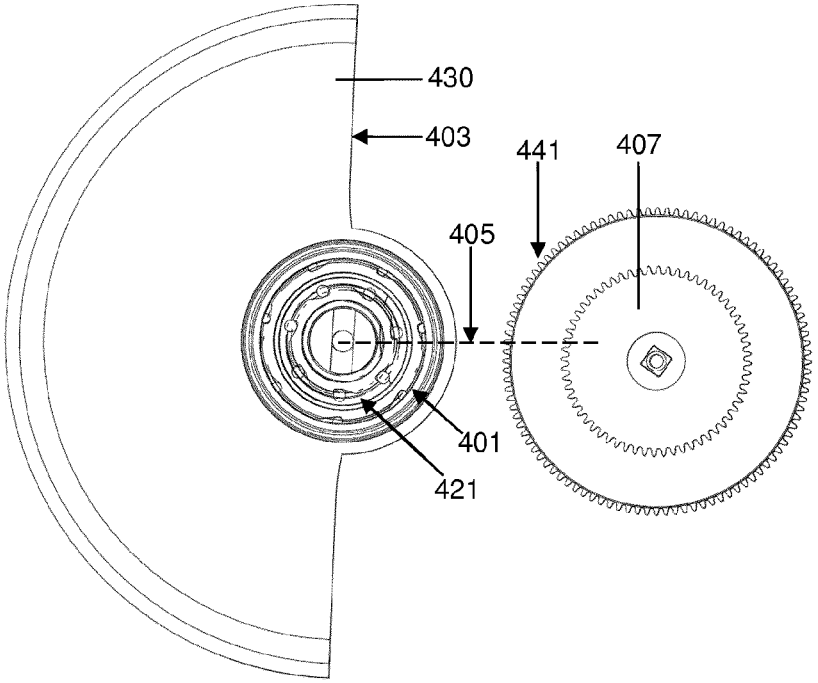
Figure 8:
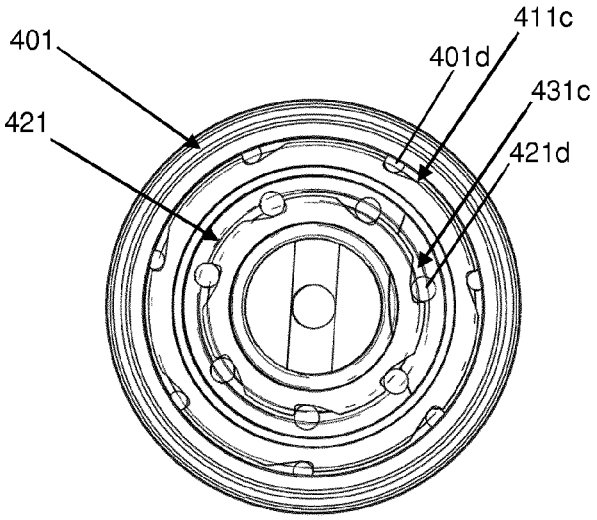

A third embodiment of the winding mechanism 510 is described hereinafter with reference to FIGS. 6 to 8. In this embodiment, the numerical references of the elements are defined by the numerical references of the elements of the second embodiment that perform the same functions, to which numerical references 200 has been added.

By comparison with the second embodiment, the third embodiment is characterized in that the ball bearing 211 is replaced by a second radial ball clutch 421. The clutches 401 and 421 are mounted in opposition here. After the manner of the principle of operation of the aforementioned embodiments, the first clutch 401 makes it possible to establish a one-way connection between the oscillating mass 403 and the ratchet 407 in a first direction of rotation of the oscillating mass 403. In this configuration, the balls 401*d* are blocked in their pockets 411*c*, while the balls 421*d* are free in their pockets 431*c*, thereby making it possible to establish rotation of the mass relative to the movement in such a way as to allow the mainspring 442 of the barrel 411 to be rewound. In a second direction of rotation of the oscillating mass 403, the balls 421*d* are blocked in their pockets 411*c* and hold the automatic winding chain 405 in position, thereby performing the same function as a pawl, notably the elastic pawls 8, 208 of the embodiments described earlier. In this configuration, the mass 403 and the outer ring 401*b* can turn relative to the inner ring 401*a*, 421*b* against the action of a resistive torque produced by the spring 402. Such a configuration advantageously makes it possible to use a simplified automatic winding chain the dead angle of which is minimized, particularly an automatic winding chain that has no elastic pawl and the dead angle of which is minimized.

The depicted embodiments of the self-winding mechanisms therefore comprise the oscillating mass, the barrel and the automatic winding chain or winding chain connecting the oscillating mass to the barrel. Thus, the barrel, particularly the barrel ratchet, is kinematically connected to the first part, notably to the first ring, or to the second part, notably to the second ring.

A pinion, kinematically connected to the barrel, particularly to the barrel ratchet, is attached or fixed to the first part, notably to the first ring, or to the second part, notably to the second ring.

As seen earlier, in the third embodiment of the winding mechanism, the mechanism comprises a framework and the second freewheel device 421. The second freewheel device is interposed between the barrel, particularly the barrel ratchet, and the framework. The second freewheel device comprises a third ring 421*a* and a fourth ring 421*b*. The fourth ring and the first ring 401*a* may coincide or form one and the same single ring. Advantageously the first and second freewheel devices are of the same type.

The action of a pawl on a ratchet is not considered to be that of a brake as provided for in the invention. Thus, a pawl is not a brake acting between two parts of a winding chain and in particular is not a brake acting on an oscillating mass of a winding mechanism.

The devices that form the subjects of the invention employ an element that generates a resistive torque which is intended to resist the oscillating mass in a direction of non-winding of the movement so as to rectify the deficiencies known from the prior art. The devices that form the subjects of the invention are particularly advantageous with regard to their simplicity and compactness.

In the devices that form the subjects of the invention, the brake is arranged in such a way as to resist the relative movement of the first and second parts, while at the same time allowing this movement. The brake is not a device for relative blocking of the first and second parts. Thus, above and beyond a certain torque, in the second direction of rotation (direction of non-winding), the first and second parts are able to move the one relative to the other. In the first direction of rotation (the direction of winding, the opposite of the second direction of rotation), the first and second parts are blocked the one relative to the other by the one-way connection device.

Another aspect of the invention relates to a timepiece device 500 comprising a barrel 441 of a mechanism 510, a framework 431 and a one-way connection device 421, particularly a clutch device, notably a freewheel device, between the barrel 441 and the framework 431. The one-way connection device 421 comprises a first ring 421*a* and a second ring 421*b*.

Advantageously, the device comprises an automatic winding chain 405 comprising at least one intermediate transmission element 405 between the one-way connection device and the barrel.

Alternatively or in addition, the device comprises an oscillating mass 403, and the one-way connection device is arranged coaxial with the oscillating mass.

This other aspect of the invention also relates to a self-winding mechanism 510 for a timepiece movement, the mechanism comprising a device as defined hereinabove.

This other aspect of the invention also relates to a timepiece movement 520, the movement comprising a device as defined hereinabove or a mechanism as defined hereinabove.

This other aspect of the invention also relates to a timepiece 530, the timepiece comprising a device as defined hereinabove or a mechanism as defined hereinabove or a movement as defined hereinabove.

In this document, the term "freewheel" or "freewheel device" does not mean "idler wheel". The term "freewheel" or "freewheel device" covers a type of one-way mechanical connection device. In a one-way connection device, a first part is allowed to rotate freely with respect to a second part only in a first direction. In a second direction (the opposite of the first direction), the first part is blocked relative to the second part, possibly after the first part has traveled through a small angle relative to the second part.

This angle is dependent on the "dead angle" covered by the oscillating mass in the direction of winding without winding the barrel just after having moved in the opposite direction to the direction of winding.

The invention claimed is:

1. A timepiece transmission device comprising:

a first one-way connection device providing connection between a first part and a second part, wherein the first one-way connection device blocks a relative movement of the first part relative to the second part in a first direction, and a brake designed to brake the first part relative to the second part in a relative movement of the first part in a second direction opposed to the first direction, wherein the brake applies a continuous braking torque resisting the movement of the first part relative to the second part in the second direction, wherein the brake has no braking effect on the first and second parts in a movement of the first and second parts in the first direction.

2. The transmission device as claimed in claim 1, wherein the first part comprises a first freewheel device ring, and the second part comprises a second freewheel device ring.

3. The transmission device as claimed in claim 2, wherein the brake is in contact with the first and second parts.

4. The transmission device as claimed in claim 2, wherein the brake is attached or fixed to the first ring.

5. The transmission device as claimed in claim 1, wherein the brake is arranged so as to act on a surface of the second part or on a surface of a second ring.

6. The transmission device as claimed in claim 1, wherein the brake comprises a spring.

7. The transmission device as claimed in claim 1, wherein the brake is preloaded by at least one of the first part and the second part.

8. The transmission device as claimed in claim 1, wherein the first one-way connecting device includes at least one blocking element.

9. A self-winding mechanism for a timepiece movement, comprising an oscillating mass, a barrel and an automatic winding chain, the automatic winding chain comprising the transmission device as claimed in claim 1.

10. The winding mechanism as claimed in claim 9, wherein the oscillating mass is attached or fixed to the first part or to the second part.

11. The winding mechanism as claimed in claim 9, wherein a pinion kinematically connected to the barrel is attached or fixed to the first part or to the second part.

12. The winding mechanism as claimed in claim 9, wherein the barrel is kinematically linked to the first part or to the second part.

13. The winding mechanism as claimed in claim 9, which comprises a framework and a second one-way connection device, the second one-way connection device being interposed between the barrel and the framework, the second one-way connection device comprising a third ring and a fourth ring.

14. The winding mechanism as claimed in claim 13, wherein one single same ring constitutes the first and fourth rings.

15. A timepiece movement comprising a device as claimed in claim 1.

16. A timepiece comprising a device as claimed in claim 1.

17. The transmission device as claimed in claim 1, wherein the first one-way connection device is a first freewheel device.

18. The transmission device as claimed in claim 1, wherein the brake is designed to brake by friction the first part relative to the second part.

19. The transmission device as claimed in claim 2, wherein the first freewheel device ring is a freewheel device inner ring and the second freewheel device ring is a freewheel device outer ring.

20. The transmission device as claimed in claim 5, wherein the brake is arranged so as to act on a planar surface of the second part or on a planar surface of the second ring.

21. The timepiece transmission device according to claim 1, wherein the brake is attached or fixed to one of the first and second parts and arranged so as to act on a surface of the other of the first and second parts.

22. The timepiece transmission device according to claim 1, wherein the first direction is a winding direction and the second direction is a non-winding direction, and wherein a braking torque of the brake in the non-winding direction is greater than 20% of a maximum static torque exerted by the oscillating mass in the non-winding direction.

23. A self-winding mechanism for a timepiece movement comprising an oscillating mass, a barrel and an automatic winding chain, wherein the automatic winding chain comprises a transmission device comprising:

a first one-way connection device providing connection between a first part and a second part, wherein the first one-way connection device blocks a relative movement of the first part relative to the second part in a winding direction, and a brake designed to brake the first part relative to the second part in a relative movement of the first part in a non-winding direction opposed to the winding direction, wherein a braking torque of the brake in the non-winding direction is greater than 20% of a maximum static torque exerted by the oscillating mass in the non-winding direction, wherein the brake has no braking effect on the first and second parts in a movement of the first and second parts in the winding direction.

* * * * *